United States Patent [19]

Pool

[11] Patent Number: 4,926,537

[45] Date of Patent: May 22, 1990

[54] TIE ROD AND BALL JOINT SEPARATOR

[75] Inventor: James L. Pool, Clarinda, Iowa

[73] Assignee: Lisle Corporation, Clarinda, Iowa

[21] Appl. No.: 423,487

[22] Filed: Oct. 12, 1989

Related U.S. Application Data

[63] Continuation of Ser. No. 245,708, Sep. 18, 1988, abandoned.

[51] Int. Cl.[5] ..... B25B 27/14

[52] U.S. Cl. ..... 29/275; 254/21

[58] Field of Search ..... 29/267, 270, 275; 254/21, 120; 81/177.1, 177.2, 489; 16/114 R

[56] References Cited

U.S. PATENT DOCUMENTS 797,804 8/1905 Gibson ..... 16/114

1,388,029 8/1921 Dimock ..... 81/177.1

3,208,134 9/1965 Krewson ..... 29/275

OTHER PUBLICATIONS

California Tool Company, p. 508, Sec. 59.

*Primary Examiner*—Judy Hartman

*Attorney, Agent, or Firm*—Allegretti & Witcoff, Ltd.

[57] ABSTRACT

An automotive separating tool that is used for separating ball joint connections, tie rods from steering arms, and other similar parts and that has wedge shaped head, with a pair of projecting prongs, and a handle. The head and handle are removably secured together by a threaded connection so that different sized heads may be used either with a handle designed to be struck by a hammer or with a handle designed to be driven by a conventional air hammer.

4 Claims, 1 Drawing Sheet

4.
5.
6.
12
14
16
18
22
24
26
28
30
32
34
36
38
42
44
46
48
52

TIE ROD AND BALL JOINT SEPARATOR

This application is a continuation of application Ser. No. 245,708, filed 9/18/88, now abandoned.

BACKGROUND OF THE INVENTION

The present invention relates to a separating tool such as a wedge and more particularly to a separating tool especially useful for automobile repair purposes. Such tools are used to separate ball joint connections and tie rod ends from steering arms by way of example.

Separating tools are well known in the automobile repair art and may include a generally wedge shaped head supported on an impact handle. The wedge shaped head typically includes a pair of spaced apart, tapered prongs that are adapted to fit between the parts to be separated. In the past, separation through the use of the tool is achieved either by sharply striking the distal end of the impact handle with a hammer or by driving the handle with an air hammer. The shape and structure of the distal end of a separating tool adapted to be struck with a hammer are generally different from that of the distal end of a separatinng tool adapted to be driven by an air hammer. The former has a blunt, large diameter end adapted to receive the blows of the hammer while the latter has a small diameter rod shape for cooperation with a compatible thrust coupling of an air hammer.

It has long been the practice in the art to make different size automotive separating tools for different jobs and parts. The principal difference between different sized relates to the dimensions of the head including the spacing between and dimensions of the prongs of the wedge shaped head. The length and overall size of the handles may also be changed proportionally as the dimensions of the wedge shaped head are changed. It has also long been recognized in the art that a well equipped automotive repair shop or garage should have at least three different sized tools. Since an automotive tool, designed to be struck by a hammer, should not be, and generally is not used with an air hammer, and vice versa, the well equipped automotive repair shop or garage usually must keep at least six different tools on hand, that is, three different size tools usable with a striking hammer and three different sized tools usable with an air hammer. In the better lines of tools, the price per tool runs approximately $40.00 so it is relatively expensive to keep all of these different sized tools in the shop or garage.

SUMMARY OF THE INVENTION

In principal aspect, the present invention relates to an improved automotive separating tool usuable for separating tie rods, ball joint connections and like parts and having an unique connection between its handle and its wedge shaped head. This connection is preferably threaded to permit ready separation of the wedge shaped head from the handle so that the same handle may be used with different sized heads. Additionally, both a handle designed for a striking hammer and a handle designed for an air hammer may be used with the same head. Hence, a well equipped automotive repair shop or garage need only purchase two handles, one designed to be struck by a hammer and the other designed for use with a conventional air hammer, and three different size heads to have all the tools that are generally required for its business. This is in contrast to the previous purchase requirement of six different tools.

Accordingly, it is an object of the present invention to provide a improved automotive separating tool for tie rods, ball joint connections and like parts wherein the separating tool includes a wedge shaped head and a separable handle and wherein a threaded connection is provided between the handle and the wedge shaped head.

A related object of the present invention is to provide an improved automotive separating tool of the type described wherein a wedge shaped head may be used with different handles, and a handle, for example, one designed to be struck by hammer, may be used with different sized, wedge shaped heads.

Another object of the present invention is to provide an improved automotive separating tool of the type described wherein the wedge shaped head has a first side or end facing in one direction, and a second side or end facing in the opposite direction, and wherein the head has a pair of tapered, spaced apart prongs extending from its one side in the one direction and adapted so that its prongs may be forced between the parts to be separated.

Still another object of the present invention is to provide an improved automotive separating tool of the type described which includes an elongated handle that may be threaded into so as to extend from the second side of the head in the other direction with a distal end adapted to be struck or driven, in the one direction, to effect separation of parts by the tool. A related object of the present invention is to provide an improved automotive separating tool of the type described wherein a threaded recess is formed in the second side of the wedge shaped head, wherein a threaded projection is formed on the other end of the handle, and wherein the threaded projection is adapted to be threaded into and received within the threaded recess so that the handle and the tapered wedge shaped head may be secured together as a unit during use of the tool to separate parts.

A further related object of the present invention is to provide an improved automotive separating tool of the type described wherein the threaded projection is formed as an integral part of the other end of the handle, wherein the depth of the threaded recess is less than the length of the threaded projection so that when the threaded projection is threaded into and received within the threaded recess, the pilot end of the threaded projection firmly abuts the tapered bottom of the threaded recess so as to reduce the stress on the threads when the distal end of the handle is being struck or driven.

A still further related object of the present invention is to provide an improved automotive separating tool of the type described wherein the pilot end of the threaded projection is tapered, and wherein the bottom of the threaded recess has substantially the same angle as the taper on the pilot end of the threaded projection.

These and still other objects, advantages and aspects of the present invention are more fully set forth in the following detailed description of the preferred embodiment of the present invention.

DESCRIPTION OF THE DRAWINGS

In the detailed description of the invention which follows, reference will be made to the accompanying drawings comprised of the following figures.

DETAILED DESCRIPTION OF THE PREFERRED EMBODIMENT

Figures 1, 2, 3, 4, 5, 6:
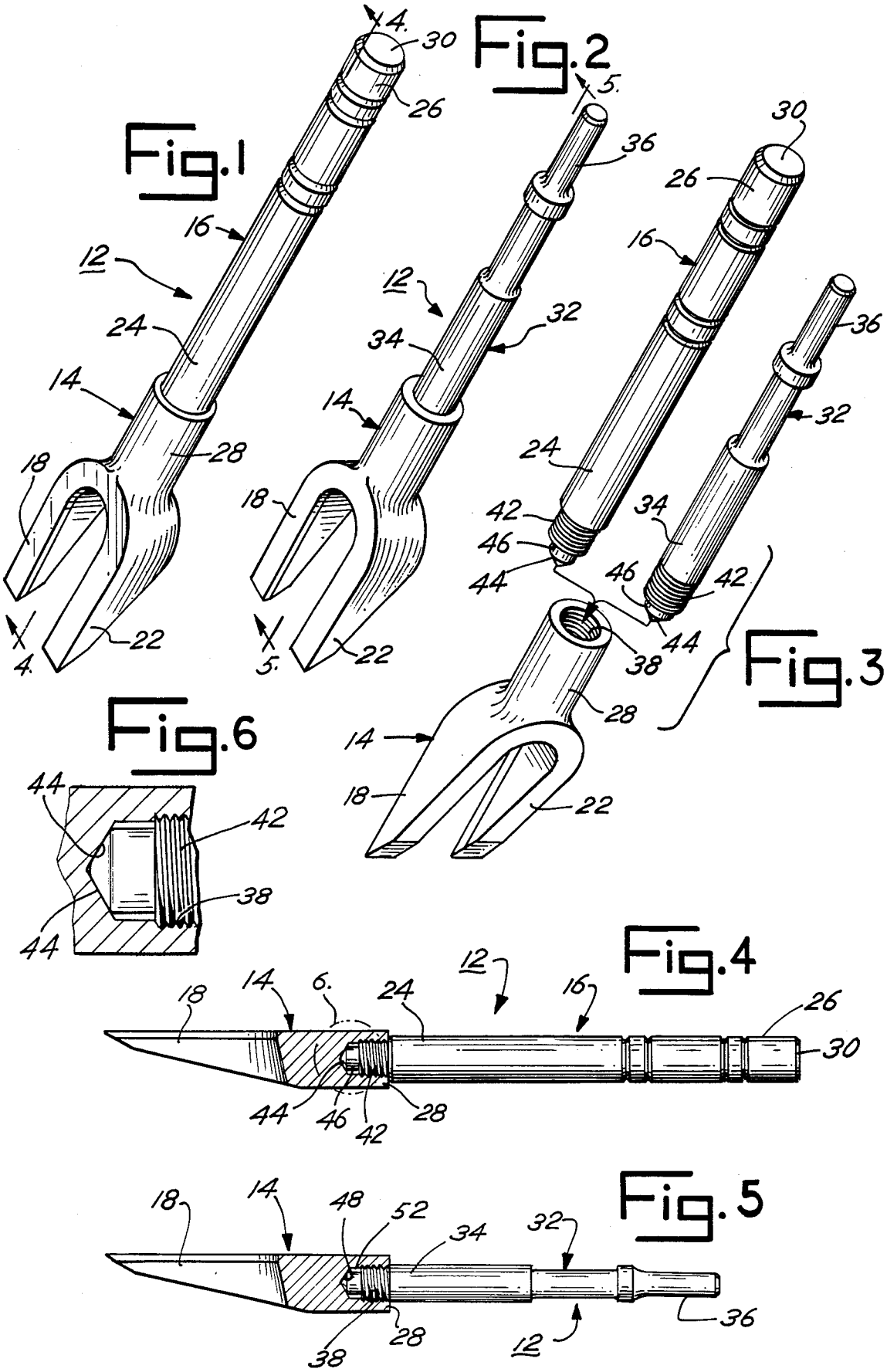
FIG. 1 is a front, right side perspective view of the improved automotive separating tool of the present invention, which tool includes a handle that is designed to be struck by a hammer.
FIG. 2 is a perspective view similar to that shown in FIG. 1 but where the handle of the tool is designed to be driven by a conventional air hammer.
FIG. 3 is a front, right side perspective view of the improved automotive separating tool of the present invention showing the tool head with two alternative handles that may be used with that head.
FIG. 4 is a partial cross-sectional view taken along the line 4—4 in FIG. 1.
FIG. 5 is a partial cross-sectional view as taken along the line 5—5 in FIG. 2.
FIG. 6 is an enlarged partial cross-sectional view of the construction of the pilot end of the handle which has been threaded into the head of the tool.

Referring to FIG. 1 of the drawings, an improved automotive separating tool of the present invention is shown generally at 12. This tool includes a tapered, wedge shaped head 14 and an elongated generally cylindrical handle 16.

One side or end of the head 14 has a pair of integral projecting prongs 18 and 22 formed thereon so as to define a generally "U" shaped fork. These prongs are of conventional design and shape, are tapered toward their distal ends and are spaced apart a preselected distance. Prongs 18 and 22 are adapted to be disposed between parts to be separated so that when force is applied to the handle 16, as hereinafter described, the head will force the parts apart. The method of manufacturing the prongs 18 and 22 as an integral part of the head 14 is well known to those skilled in the art.

In the past, it has generally been the practice to separate the prongs 18 and 22 a particular distance. For example, the prongs 18 and 22 may be separated a distance of 1⅛ inches, 15/16th inches.

The handle 16 has a first end 24, which is adjacent to and secured to the tapered wedge shaped head 14 as hereinafter described, and a distal end 26. More specifically, the end 24 of the handle is threadedly connected with the other side or end 28 of the head 14, that is, to the side or end opposite from the side or end from which the prongs 18 and 22 project. The distal end 26 of the handle, as well as the entire handle, is designed so that the handle may be repeatedly struck by a hammer being used by a mechanic or workman. In this regard, the end 26 includes a flat surface 30 to receive the hammer blows. The surface 30 is substantially perpendicular to the longitudinal axis of the handle 16.

As best illustrated in FIG. 2, the tool 12 is adapted to be used with another handle 32 that is designed and shaped, in the normal manner, to be driven by a conventional air hammer. Like the handle 16, the handle 32 includes a first end 34 and a distal end 36. As will be described hereinafter, the first ends 24 and 34 of the handles 16 and 32 are structurally and functionally identical. The distal end 36 of of the handle 32, as noted above, is designed for use with a conventional air hammer. Because the head of the tool shown in FIG. 2 is structurally and functionally identical to the head 14 of the tool shown in FIG. 1, the same reference numbers have been used to indicate the same parts.

With reference now to FIGS. 3–5, the side or end 28 of the head 14 has a generally centrally located recess 38 formed therein. This recess is internally threaded. Its central longitudinal axis is coaxial with the longitudinal axis of the head 14 and also with the central longitudinal axis of the handle when the handle is disposed within the recess as hereinafter described.

More specifically, the first ends 24 and 34 the handles 16 and 32 are adapted to be received within the recess 38. Each of the ends 24 and 34 of these handles includes an identical threaded projection 42 that has a reduced diameter, as compared to the dimensions of the adjacent portion of the handle. For this reason, only one such projection is described. The pilot end 44 of the projection is tapered to a point. An unthreaded land 46 separates the tapered pilot end 44 from the threads on the projection 42.

The threads formed in the recess 38 do not extend to the bottom of the recess. Rather, there is a short space 52 between the bottom of the recess 38 and the innermost ends of the threads formed in the recess 38. The bottom of the recess 38 is tapered, as at 48, with the angle of taper being substantially identical to the angle of taper on the pilot end 44 of the projection 42.

As depicted in FIG. 6, the lengths of the threads in the threaded recess 38 and on the threaded projection 42 are selected so that when a handle 16 is threaded into the recess 38, the pilot end 44 will bottom out or abut the tapered bottom 48 of the recess 38. This bottoming out or abutment reduces the stress on the threads when the handle 16 is struck by a hammer or is driven by an air hammer. In practice, the pilot end 44 has a frustoconical shape and the tapered bottom 48 of the counterbore or recess 38 has a compatible conical shape thereby accommodating any slight dimensional discrepancies of the pilot end 44.

A tool embodying the principles of the present invention has been made. In this tool, the threads in the recess 38 are ⅝ths-11 UNC-2B with a pitch diameter of 0.5732–0.5660 inches. The length of the thread is 0.5 inches with the length of the land 52 is 0.185 inches. The bottom 48 of the recess is tapered at an angle of 59 degrees. The threads from on the projection 42 of the handles are ⅝ths-11 UNC-2A, with a pitch diameter of 0.5644–0.3589 inches. The tip of the pilot end 44 is tapered at an angle of 59 degrees. The land 46 has a length of 0.185 inches, and the projection is chambered between this land and the adjacent end of the threads at an angle 45 degrees. As noted above, dimensions of projections 42 on the handles 16 and 32 are such that when a handle is threaded into the recess 38, the pilot end 44 of the projection 42 will bottom out or abut the bottomm of the recess 38.

The preferred embodiment of the present invention has now been described. This preferred embodiment constitutes the best mode contemplated by the inventor for carrying out his invention. Because his invention may be copied without copying the precise details of the preferred embodiment, the following claims particularly point out and distinctly claim the subject matter which the inventor regards as his invention and wishes to protect.

I claim:

1. In an automotive separating tool for tie rods, and ball joint connections, the separating tool including: a wedge-shape head that has a first end facing in one direction and a second end facing in the other, opposite direction, that has a pair of tapered spaced-apart prongs extending from the one end of the head in the one direction, with the tapered portion of the prongs creating a wedge to be forced between the parts to be separated;

and an elongated handle that extends from the second end of the head in the other direction, said handle having a first end and a distal end, said distal end being adapted to be struck in the one direction during the separating of the parts; the shape of the distal end of the handle being one of either a shape where the distal end may be struck by a hammer or a shape where the distal end may be driven by an air hammer; the improvement comprising:

a threaded recess formed in the second end of the head with the threaded recess having a tapered bottom; and a threaded projection formed on the first end of a handle, with the pilot end of the threaded projection being tapered and with the threaded projection being removably threaded into and received within the threaded recess so that the handle and head are connected together during the use of the tool to separate parts, wherein the depth of the threaded recess is less than the length of the threaded projection so that when recess and said projection are threaded together, said recess and said projection tapered surfaces matiningly engage and firmly abut each other to act as means for reduction of the stress on the threads when the handle is driven or hammered.

2. The improved separating tool of claim 1 wherein the handle and the head may be readily separated by unthreading the connection between the threaded recess and the threaded projection so that the handle and head may be used with other heads and handles, respectively.

3. The improved separating tool of claim 1 wherein the threaded recess is formed within the head and the threaded projection is integrally formed on the first end of handle, with the longitudinal axis of the handle is co-axial with the longitudinal axis of the threaded projection and the threaded recess.

4. In an automotive separating tool for tie rods, and ball joint connections, the separating tool including: a wedge-shape head that has a first end facing in one direction and a second end facing in the other, opposite direction, that has a pair of tapered spaced-apart prongs extending from the one end of the head in the one direction, with the tapered portion of the prongs creating a wedge to be forced between the parts the second end of the head in the other direction, said handle having a first end and a distal end, said distal end being adapted to be struck in the one direction end during the separating of the parts the shape of the distal end of the handle being one of either a shape where the distal end may be struck by a hammer or a shape where the distal end may be driven by an air hammer; the improvement comprising:

a connection means between said second end of the head and said first end of the handle, whereby one end portion of the connection means includes a threaded recessed having a tapered bottom generally conical in shape;

and a second portion of the connection means includes a threaded projection a pilot end of the threaded projection being tapered and having a compatible generally frustoconical shape for cooperation and mating engagement with the conical surface of the tapered bottom to act as means for reducing the stress on the threads when the handle is struck or driven to drive the head, and with the threaded projection being removably threaded into and received within the threaded recess so that the handle and head are connected together during use of the tool, wherein the depth of the threaded recess is less than the length of the threaded projection so that when the threaded projection is threaded into and received within the threaded recess, the pilot end of the threaded projection firmly abuts the tapered bottom of the threaded recess so as to reduce the stress on the threads.

* * * * *